US009592529B2

(12) United States Patent
Xiangli

(10) Patent No.: US 9,592,529 B2
(45) Date of Patent: Mar. 14, 2017

(54) WEATHER RESISTIVE BARRIER WITH DRAINAGE SURFACE

(71) Applicant: INNOVATIVE CONSTRUCTION MATERIALS (H.K.) LTD., Beijing (CN)

(72) Inventor: Wang Xiangli, Shanghai (CN)

(73) Assignee: Innovative Construction Materials (H.K.) Ltd., Beijing (CN)

( * ) Notice: Subject to any disclaimer, the term of this patent is extended or adjusted under 35 U.S.C. 154(b) by 156 days.

(21) Appl. No.: 13/738,079

(22) Filed: Jan. 10, 2013

(65) Prior Publication Data

US 2013/0180203 A1 Jul. 18, 2013

Related U.S. Application Data

(60) Provisional application No. 61/586,246, filed on Jan. 13, 2012.

(51) Int. Cl.

| | |
|---|---|
| ***B05D 1/32*** | (2006.01) |
| ***E04B 1/62*** | (2006.01) |
| ***E04B 1/66*** | (2006.01) |

(52) U.S. Cl.

CPC ..... *B05D 1/32* (2013.01); *E04B 1/62* (2013.01); *E04B 1/625* (2013.01); *E04B 1/665* (2013.01); *B05D 2701/00* (2013.01); *Y10T 428/24802* (2015.01)

(58) Field of Classification Search

CPC ..... B05D 1/32; B05D 2701/00

See application file for complete search history.

(56) References Cited

U.S. PATENT DOCUMENTS

| | | | | |
|---|---|---|---|---|
| 1,597,230 | A * | 8/1926 | Hartshorne | 242/118.1 |
| 3,357,848 | A * | 12/1967 | Donahue et al. | 427/203 |
| 5,075,135 | A * | 12/1991 | Brandt | 427/180 |
| 5,690,448 | A * | 11/1997 | Fasullo et al. | 405/129.7 |
| 5,728,424 | A * | 3/1998 | Walling | 427/180 |
| 6,024,824 | A * | 2/2000 | Krech | 156/279 |
| 6,557,313 | B1 * | 5/2003 | Alderman | B32B 7/02 52/407.2 |
| 7,887,900 | B2 | 2/2011 | DiPede | |
| 2002/0061723 | A1 * | 5/2002 | Duescher | 451/527 |
| 2003/0215594 | A1 * | 11/2003 | Hamdar | B32B 3/08 428/40.1 |
| 2004/0112811 | A1 * | 6/2004 | Lindemulder | 210/163 |
| 2006/0048454 | A1 * | 3/2006 | Welygan et al. | 51/298 |

(Continued)

FOREIGN PATENT DOCUMENTS

CA 2597138 A1 8/2006

*Primary Examiner* — Michael P Rodriguez

(74) *Attorney, Agent, or Firm* — William A. Ziehler; Fraser Clemens Martin & Miller LLC

(57) ABSTRACT

Weather resistive barriers and methods of making such are provided. A weather resistive barrier provides a space permitting drainage of liquid water or condensation and for air movement. Applications include where the weather resistive barrier is coupled to a sheathing material and further covered with an exterior building covering, thereby providing space between the sheathing material and the exterior building covering. In this way, the amount of moisture exposure experienced by a structure can be controlled and the structure protected. The extent of water drainage and airflow can be tailored according to particular applications.

18 Claims, 2 Drawing Sheets

(56) References Cited

U.S. PATENT DOCUMENTS

| | | | | |
|---|---|---|---|---|
| 2007/0026195 | A1* | 2/2007 | Pinault et al. | 428/141 |
| 2010/0139178 | A1* | 6/2010 | Ehrman | B32B 5/08 52/58 |
| 2014/0134408 | A1* | 5/2014 | Milne | E04B 1/665 428/195.1 |

* cited by examiner

WEATHER RESISTIVE BARRIER WITH DRAINAGE SURFACE

CROSS-REFERENCE TO RELATED APPLICATIONS

This application claims the benefit of U.S. Provisional Application Ser. No. 61/586,246, filed on Jan. 13, 2012. The entire disclosure of the above application is incorporated herein by reference.

FIELD

The present technology relates to a weather resistive barrier, such as a house-wrap, made using a drop coating process that provides a water drainage surface.

BACKGROUND

This section provides background information related to the present disclosure which is not necessarily prior art.

Buildings, including residential and commercial structures, typically have a frame, a sheathing material over the frame, and an exterior building covering over the sheathing material. A house wrap can also be used, where the house wrap is typically placed between the sheathing material and the exterior building covering to serve as a moisture barrier and inhibit water intrusion into the building. House wraps can also inhibit air intrusion into the building to help to prevent energy loss and mitigate climate control issues. For example, inner sheathing members of a wall and/or roof are covered with various types of building paper, tar paper, roofing felt, house-wrap material, and the like to provide a weather barrier to help block the penetration of air and/or water into the building through an exterior wall or roof. A house wrap made of thermoplastic materials can also be designed to permit water vapor to escape through the exterior wall or roof. Examples of thermoplastic house wrap materials include Tyvek™ HomeWrap, available from DuPont (Wilmington, Del.), and Typar™ HouseWrap, available from BBA Fiberweb (Old Hickory, Tenn.).

Liquid water can sometimes get behind the exterior building covering through cracks or seams in the exterior building covering or through window and door joints. What is more, moisture from the relatively warm interior of the building can penetrate through the sheathing material and the house wrap and can condense into liquid water upon contacting a relatively cold exterior building covering. Liquid water can subsequently become trapped between the house wrap and the exterior building covering and may cause water damage. Trapped water can also encourage growth of mold and mildew, which in turn can cause degradation of building components and health concerns.

SUMMARY

The present technology includes systems, processes, articles of manufacture, and compositions that relate to a weather resistive barrier, such as a house wrap.

The weather resistive barrier comprises a flexible sheet having a plurality of protuberances on at least one side. The protuberances can abut another building component, such as an exterior building covering, and thereby provide and maintain a space between the flexible sheet and the building component. The space provides a water drainage surface and allows for air flow. The weather resistive barrier can be made by a method that includes drop coating a material onto the flexible sheet to form the plurality of protuberances on at least one side of the flexible sheet. The weather resistive barrier can also be used to protect a structure where the weather resistive barrier is coupled to the structure. For example, the weather resistive barrier can be coupled to a sheathing material and further covered with an exterior building covering, thereby providing space between the sheathing material and the exterior building covering.

Further areas of applicability will become apparent from the description provided herein. The description and specific examples in this summary are intended for purposes of illustration only and are not intended to limit the scope of the present disclosure.

BRIEF DESCRIPTION OF THE DRAWINGS

The drawings described herein are for illustrative purposes only of selected embodiments and not all possible implementations, and are not intended to limit the scope of the present disclosure.

DETAILED DESCRIPTION

Figure 1:
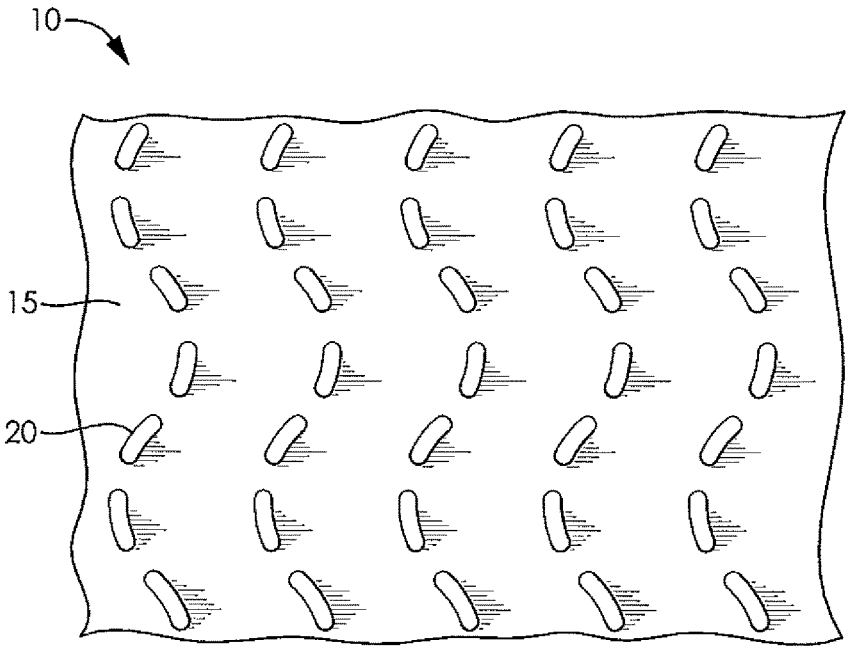
FIG. 1 shows an embodiment of a weather resistive barrier comprising a flexible sheet having a plurality of protuberances on one side.

The following description of technology is merely exemplary in nature of the subject matter, manufacture and use of one or more inventions, and is not intended to limit the scope, application, or uses of any specific invention claimed in this application or in such other applications as may be filed claiming priority to this application, or patents issuing therefrom. Regarding the methods disclosed, the order of the steps presented is exemplary in nature, and thus, the order of the steps can be different in various embodiments. Except in the examples, or where otherwise expressly indicated, all numerical quantities in this description indicating amounts of material or conditions of reaction and/or use are to be understood as modified by the word "about" in describing the broadest scope of the technology.

The present technology relates to a weather resistive barrier such as a house wrap or building wrap. The weather resistive barrier includes at least one surface that is modified using a drop coating process to form a plurality of protuberances that provide and maintain a space when the weather resistive barrier abuts another surface. In particular, the weather resistive barrier comprises a sheet with a plurality of protuberances to provide the space allowing for water and air movement. The sheet can be flexible and can be provided in various sizes and shapes, including strips, perforated sheets, precut sheets, and spirally wound rolls. Where the sheet is a substantially planar sheet, the protuberances can be present on one or both sides of the sheet to provide the space for water drainage and air movement. The weather resistive barrier can be manufactured by a drop coating process that includes drop coating a material onto the sheet to form protuberances of the material on a surface of the sheet, optionally followed by curing or drying the material.

In some embodiments, the weather resistive barrier comprises a flexible sheet having a plurality of protuberances on at least one side. The weather resistive barrier can also have protuberances on each side of the flexible sheet. The various protuberances can independently have various sizes and/or shapes or the protuberances can be substantially uniform in dimension. Spacing and orientation of the protuberances can be tailored to provide open areas and pathways for water drainage and/or airflow. In certain embodiments, the plurality of protuberances comprises a two-dimensional pattern on the surface of the sheet. The pattern can be one or irregular, asymmetrical, symmetrical, and can comprise a repeating pattern.

The protuberances provide a space or gap between the sheet of the weather resistive barrier when it abuts another surface, such as an exterior building covering or sheathing material. The space formed by the various protuberances consequently allows for air circulation that can remove water vapor and condensation and can allow liquid water to drain along the surface of the sheet. For example, the protuberances can be arranged in various patterns and spacings to form a water drainage surface that provides various regions, pathways, or channels for movement of air and water. In some aspects, the peaks of the various protuberances can appear as islands on the surface of the sheet or protuberances may have extended lengths across the sheet surface forming channels and/or directing air and water in one or more particular directions. The protuberances may also be arranged as a mixture of islands and channels on the sheet surface.

The weather resistive barrier can include a drainage surface by providing an ample drainage space between the protuberances. To contribute and assist as a capillary break and to provide an air space between the siding and sub-sheathed wall envelope, a drainage gap provided by the protuberances can have a minimum of about 1 mm to about 10 mm in depth or height. At these dimensions, the drainage gap provides a well-defined drainage space. That is, the protuberances can typically have dimensions ranging from about 1 mm to about 10 mm in height from the sheet surface, although other heights are possible. Embodiments also include where each protuberance is independently about 1 mm to about 10 mm in each of length, width, and height. However, one or more of the protuberances can have lengths in excess of 10 mm in a drainage direction and multiple protuberances can be aligned to form channels in the drainage direction.

The protuberances can comprise one or more materials. Useful materials include materials that can be either rigid or flexible in nature. Where the material is rigid, the material can be substantially incompressible. Flexible protuberances can be deformable and can be elastic, where the protuberances can recover their shape after deformation. Material used to form the protuberances can include solid materials or materials that include a hollow portion. For example, the material can be a foam having one or more hollow cells therein.

In certain embodiments, the plurality of protuberances can comprise one or more polymeric materials. Examples of polymeric materials include polyolefins, including thermoplastic polyolefins such as polyethylene and polypropylene, and polyolefin elastomers, such as polyisobutylene, ethylene propylene rubber, and ethylene propylene diene monomer rubber. Other polymeric materials include polyesters and polymers formed from ethyl vinyl alcohol and ethyl methyl alcohol. Further examples of polymeric materials include thermoset materials such as polyester fiberglass systems, polyurethanes, rubber, urea-formaldehyde, melamine resins, and epoxy resins.

In particular embodiments, the polymer can include a thermoplastic polyolefin (TPO). Such thermoplastic polyolefins can include polymer/filler blends, including one or more fractions of polypropylene, polyethylene, block copolymer polypropylene, rubber, and a reinforcing filler, Reinforcing fillers include fiberglass, carbon fiber, talc and various other minerals. Rubbers include ethylene propylene rubber, ethylene propylene diene monomer (M-class) rubber, ethylene-octene, ethylene-butadiene, and styrene-ethylene-butadiene-styrene.

The material used to form the protuberances can also include one or more additives such as dioctyl phthalate, calcium carbonate, and the like. The material, including one or more polymeric materials and additives, can be blended, melt-mixed, and/or formed into a liquid, semi-liquid, or mass that has a gel or paste-like consistency that is amenable to pumping, flowing, or passing through a drop coating apparatus. In some embodiments, a suitable blend of materials for drop coating includes low density polyethylene and ethylene vinyl acetate, dioctyl phthalate, silicon dioxide, and calcium carbonate.

The protuberances can be made using a material that can be cured or dried to form a solid material. For example, the material can be cured to strengthen or harden the polymer material by various methods including the cross-linking of polymer chains, through the use of chemical additives, exposure to ultraviolet radiation, an electron beam, or heat. Heating can be effected by hot air and/or infrared lamps. Where the material includes a rubber, the curing process can include vulcanization. The water drainage surface comprising the protuberances can be thermally bonded to the sheet during drying or curing of the material used to form the protuberances; for example, where the sheet comprises a polymeric material such as a thermoplastic material, a synthetic resin, olefin resin, polyolefin polymer, polypropylene, high density polyethylene, polystyrene, nylon, polyvinyl chloride, or the like.

The protuberances on the sheet form a space to permit water drainage and air flow. The weather resistive barrier can be positioned behind exterior building coverings or claddings to provide a ventilation space to ensure an uninterrupted drainage gap and act as a capillary break between exterior coverings and the remainder of the wall. The function of this space can become more important as rain loading on a building increases as more water may drain within this space more often in high exposure locations. To allow for ventilation airflow, the space or gap provided by the protuberances of the weather resistive barrier can be as unobstructed and large as necessary for a particular application. In some applications, however, small gaps can allow a beneficial amount of ventilation flow.

The flexible sheet can include one or more sheet materials and can be a laminate of sheet materials having a plurality of layers. Examples of suitable sheet materials include those made of polymer, paper, tar paper, felt, roofing felt, and the like. In some embodiments, the flexible sheet can be provided in an indefinite-length elongate web and that is capable of being stored and shipped in a spirally wound roll, Other shapes and forms of the sheet include strips, perforated sheets, and precut sheets.

The sheet material may be vapor permeable or impermeable. In embodiments where the sheet material is impermeable, the sheet may be any suitable impermeable sheet, such as films or sheets of polyolefins, including polypropylene, polyethylene or polyvinyl chloride or other impermeable weather resistant building papers. In embodiments where the sheet material is vapor permeable, the vapor permeable flexible sheet may be any suitable vapor permeable sheet that is water resistant. For example, the vapor permeable flexible sheet may be any suitable breathable sheet material made of spun bonded synthetic fibers such as polyethylene, polypropylene or polyester fibers, sheets of spun bonded-melt blown-spun bonded polymer fibers (or other non-woven fabricated products), perforated polymer films, woven slit film, microporous film laminates, and building papers.

The sheet can also comprise a rolled-on or sprayed-on liquid that dries or cures as a film directly on another material, such as another sheet or a building material or component such as sheathing material. In addition, the sheet can include one or more of a woven material, a non-woven material, a dry-laid non-woven material, a wet-laid non-woven material, a hybrid non-woven material, a polymer-laid non-woven material, a spun-bonded non-woven material, a flash-spun non-woven material, or the like. The sheet material can include natural materials, such as cellulose and other plant derived products, used alone or in conjunction with the various synthetic materials described herein.

Various additives can be included or applied to the sheet. Examples include various colorants, heat stabilizers, waterproofing treatments, strengthening laminates, antimicrobials, UV blockers and light stabilizers, and flame retardants. The sheet can be also be printed with signage, such as logos, installation instructions, and orientation indicia. For example, the sheet may include protuberances that provide a directional flow for water and air movement, such as where the protuberances form channels, and the sheet can be marked with indicia to indicate the designed flow direction. In certain aspects, the building wrap, including the sheet and/or the protuberances, can include suitable additives.

In some embodiments, the sheet of the weather resistive barrier can comprise a commercial house wrap used under an exterior building covering such as exterior siding/cladding including wood, vinyl, brick, metal, stucco, cementitious and hardboard and fastened or secured to or over a sub-sheathing and/or wood framed wall envelope. In certain embodiments, the sheet can comprise Tyvek™ HomeWrap, available from DuPont (Wilmington, Del.), Typar™ HouseWrap, available from BBA Fiberweb (Old Hickory, Tenn.), or equivalents thereof. In certain embodiments, the sheet can include an insulating material, such as fiberglass, or may be combined with or coupled to an insulating material, or the sheet can be used and/or installed in conjunction with an insulating material.

In some aspects, the weather resistive barrier can be manufactured using a drop coating process. The drop coating process can add one or more protuberances in an interrupted or uninterrupted pattern having various shapes onto the surface of the sheet, where the protuberances provide the space for water drainage and air movement between the siding and the wall envelope. For example, the method of making the weather resistive barrier can include drop coating a material onto the flexible sheet to form the plurality of protuberances on at least one side of the sheet.

Drop coating includes allowing the material to drop onto the surface of the sheet. The material may drop onto the sheet with the assistance of gravity. In some embodiments, the material drop coated onto the sheet may experience free-fall from a drop coating apparatus onto the sheet, where the material falls freely through the air to land upon the sheet. In other embodiments, the material may be laid onto the sheet from the drop coating apparatus, where the material contacts the sheet before completely separating from the drop coating apparatus. In each case, however, there is a distance between the drop coating apparatus and the sheet. That is, the drop coating apparatus does not directly contact the sheet. The distance allows the material to be laid or deposited onto the sheet so that the material retains a height projecting from the sheet surface. For example, the distance between the drop coating apparatus and the sheet can be tailored to change the desired height of the resulting protuberances.

As mentioned, the drop coating process can include where the material drops onto the sheet with the assistance of gravity. The material can be forced out of the drop coating apparatus toward the sheet, however, in so doing, the rate used to deposit the material onto the sheet from the drop coating apparatus can be substantially equal to or less than the rate the material would experience in free fall by the force of gravity. In other words, the material is not forcibly ejected toward the sheet using a force that would result in the material dropping to sheet with a rate substantially greater than would be provided by gravity.

Drop coating can be performed using a drop coating apparatus to deposit material to from the protuberances. Various types of drop coating apparatus can be used, including one or more nozzles for dropping quantities of material onto the sheet. In some embodiments, the drop coating step comprises passing the material through a drop coating die. Various dies can be used to provide various shapes and dimensions of material deposited onto the sheet.

In some embodiments, the drop coating die can include a cylinder having a plurality of perforations. For example, the plurality of perforations can comprise a two-dimensional pattern on the cylinder. Various patterns can be used, including symmetrical, asymmetric, directional, and repeating patterns. The cylinder can be rotated while drop coating the material onto the flexible sheet. In this way, successive protuberances can be deposited onto the sheet from the cylinder perforations. Either the cylinder or the flexible sheet can be moved with respect to the other while drop coating the material onto the flexible sheet. For example, the sheet can be moved under the rotating cylinder to that material is deposited onto the sheet forming a plurality of protuberances corresponding to the perforation pattern of the cylinder. The sheet can be further moved past a curing station, where hot air, infrared lamps, ultraviolet lamps, electron beams, or other means are used to dry and/or cure the material forming the protuberances as described herein.

The drop coating method can include four stages.

First, a drop coating die cylinder is formed. One suitable means is to use a sheet metal-like plate cut following a desired design (e.g., using a computer numerical control (CNC) machine), where the cut plate is then curved and formed into a round sleeve to provide a drop coating die cylinder. The pattern of the perforations in the cylinder can be tailored to provide the desired array of protuberances; for example, the spacing, size, and frequency of the perforations can be adjusted as needed.

Second, the material that will form the protuberances is moved through the drop coating die cylinder. As described, the material can include a polymer like TPO, and additives like dioctyl phthalate (DOP), calcium carbonate, etc., which can be premixed at room temperature into a liquid or paste which can be fed into the drop coating die cylinder. The process can be continuous, where the material is moved or pumped into the cylinder to prevent the cylinder from running empty.

Third, the drop coating process can be incorporated into a moving production line. In particular, the material used to form the protuberances, such as the blended mixture of polymer and additives, can be pumped or fed into the drop coating die cylinder. The drop coating die is rotated in place above a flying/moving sheet while the material used to form the protuberances drops from the die cylinder onto the moving sheet. Alternatively, the sheet may be static and the rotating die moved relative to the sheet to drop material and form protuberances along the length of the sheet.

Fourth, the flying/moving sheet carrying the dropped material is dried or cured to form the weather resistive barrier having a plurality protuberances. For example, the sheet having the material dropped and deposited thereon can be passed through a hot air oven to bake the material and form the protuberances on the sheet. The production line can include other stations, such as additional drying or curing stations, processing stations to cut, trim, or perforate the finished weather resistive barrier, and packaging stations, such as a winding station to package the resulting weather resistive barrier into a spirally wound roll.

The drop coating method can be tailored as needed according to the performance of the drop coating apparatus, the material used to form the protuberances, drying or curing rate of the material, and the desired production line movement rate.

A weather resistive barrier in accordance with the present technology has several uses, such as wrapping houses and commercial buildings, including use as an underlayment for roofing materials. The weather resistive barrier provides a unique surface that forms a space when the weather resistive barrier abuts another surface. The space allows air flow to remove moisture and allows liquid water to drain along the barrier surface. The weather resistive barrier can be used to protect a structure. Methods of protecting a structure include coupling the weather resistive barrier to the structure, where the weather resistive barrier comprises a flexible sheet having a plurality of protuberances on at least one side. The weather resistive barrier can be further coupled to a sheathing material and can be covered with an exterior building covering, thereby providing a space between the sheathing material and the exterior building covering.

The weather resistive barrier can be secured to another building component, such as a sheathing material in construction of a building, by any suitable means, including the use of nails, staples, or screws. The weather resistive barrier can be unrolled on, and secured to, inner sheathing members in a building such that the weather resistive barrier completely covers the inner sheathing members and such that the protuberances face away from the inner sheathing members. Several slightly-overlapping, horizontally-extending rows of the weather resistive barrier may be required to cover the entire elevation of the sheathing and/or building.

An exterior building covering or material can be affixed on the outer side of the weather resistive barrier such that it overlies the weather resistive barrier and sandwiches the weather resistive barrier between the inner sheathing and exterior building covering. The exterior building covering can be, for instance, a wood or fiber-cement siding product or wooden shingles such as cedar shakes. The exterior building covering can also be brick, stone, stucco, exterior insulation finish systems, vinyl, metal, asphalt, rubber, thermoplastic, and other exterior siding and roofing materials. Thus, the weather resistive barrier described herein, including wall and roof assemblies containing the building wrap, and methods of manufacture according to the present technology, can provide an effective way to manage moisture within building structures.

EXAMPLES

With reference now to FIGS. 1-4, an embodiment of a weather resistive barrier 10 is shown. The weather resistive barrier 10 includes a flexible sheet 15 having a plurality of protuberances 20 on one side of the sheet. The protuberances 20 are formed from a blend of materials that includes low density polyethylene, ethylene vinyl acetate, dioctyl phthalate, silicon dioxide, and calcium carbonate. The sheet 15 is formed of flashspun high-density polyethylene fibers and is permeable to water vapor but not liquid water. As shown, the protuberances 20 are arranged on the flexible sheet 15 in a two-dimensional repeating pattern. The pattern of protuberances 20 shown includes several series of rounded rectangles that follow generally sinusoidal paths. The protuberances 20 project from the sheet 15 at a height 25, where all the protuberances 20 have substantially the same height 25.

Figure 2:
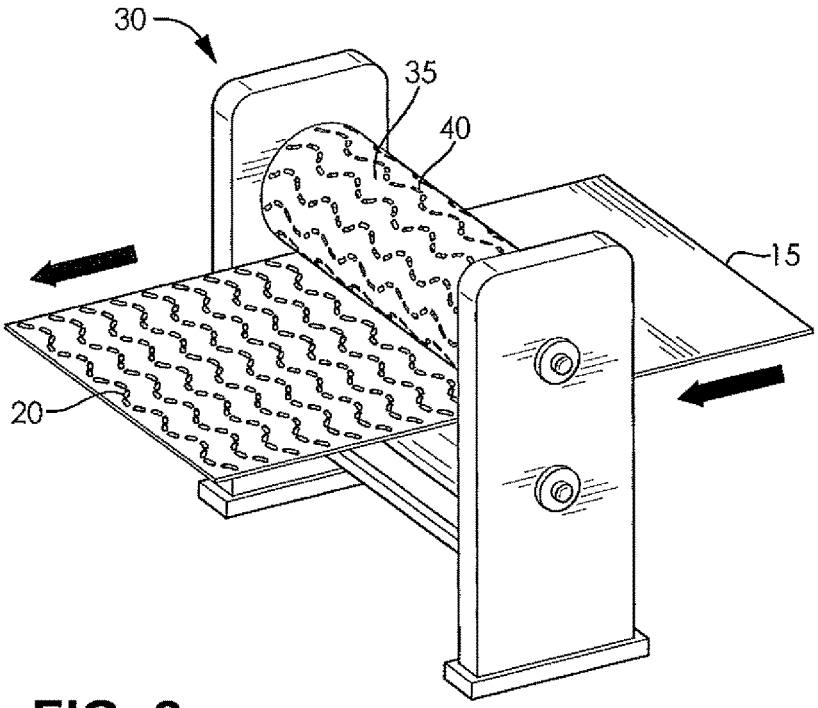
FIG. 2 shows a perspective view of an embodiment of a drop coating process used to make the weather resistive barrier of FIG. 1, where the process employs a perforated metal cylinder as a drop coating die to deposit a material onto a sheet and form a plurality of protuberances.
Figure 3:
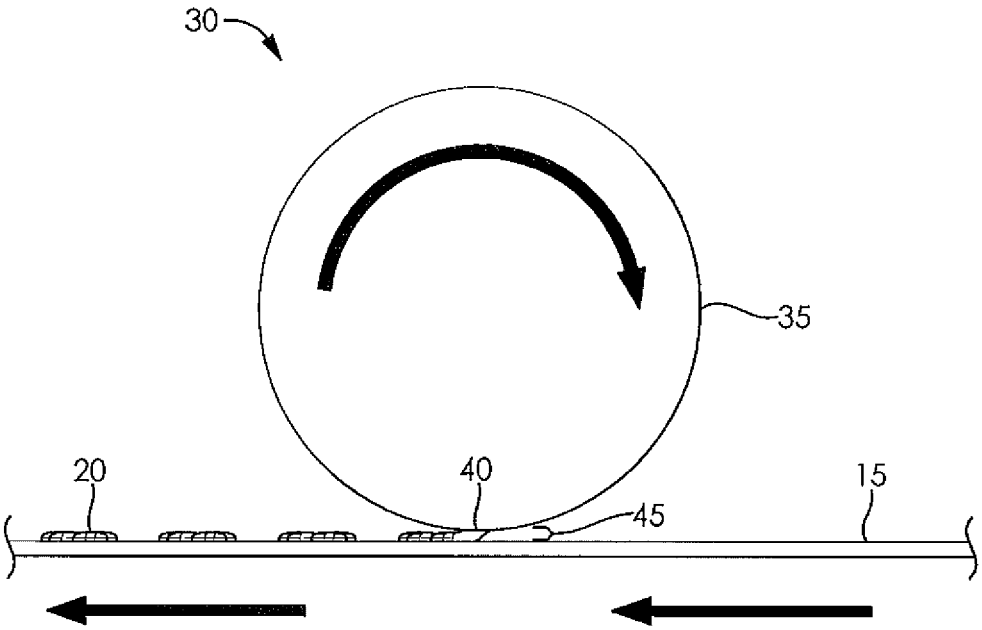
FIG. 3 shows a side elevational view of the drop coating process shown in FIG. 2, where rotation of the perforated metal cylinder and movement of the sheet are indicated by arrows.

The weather resistive barrier 10 shown in FIG. 1 is made using a drop coating method with the drop coating apparatus 30 as depicted in FIGS. 2-3. The flexible sheet 15 is moved beneath a rotating, cylindrical drop coating die 35 having a plurality of perforations 40 therein. As shown, the longitudinal axis of the cylindrical drop coating die 35 is disposed substantially parallel with the side of the flexible sheet 15 upon which the material is dropped to form the protuberances 20. The perforations 40 in the drop coating die 35 correspond to the resulting pattern of protuberances 20. A heated, semi-liquid or paste-like material including low density polyethylene, ethylene vinyl acetate, dioctyl phthalate, silicon dioxide, and calcium carbonate is present within the rotating, cylindrical drop coating die 35. The material can be at a temperature between 100-180 degrees C. As the cylindrical drop coating die 35 is rotated and the flexible sheet 15 is moved beneath, the material drops out of the perforations 40 in the drop coating die 35 onto the sheet 15.

As shown in FIG. 3, there is a distance 45 between the drop coating die 35 and the flexible sheet 15. The distance 45 can be substantially the same as the height 25 of the protuberances 20. However, there can be a difference between the height 25 of the protuberances 20 and the distance 45 between the drop coating die 35 and the flexible sheet 15 upon subsequent drying or curing of the protuberances 20, where the drying or curing can cause the protuberances 20 to change in dimension.

The flexible sheet 15 is moved at a rate of up to 50 meters per minute and the cylindrical drop coating die 35 is rotated at a corresponding rate to drop the material onto the flexible sheet 15 and form the protuberances 20. A drying and/or curing station (not shown) can be positioned downstream of the drop coating apparatus 30 to anneal the protuberances 20 to the flexible sheet 15. One example of a drying station includes a drying oven that covers up to 50 meters of the weather resistive barrier 10 and provides a drying time of about 250 seconds, depending on the movement rate of the flexible sheet 15. After drying, a packaging station (not shown) can wind the finished weather resistive barrier 10 onto spirally wound rolls.

Figure 4:
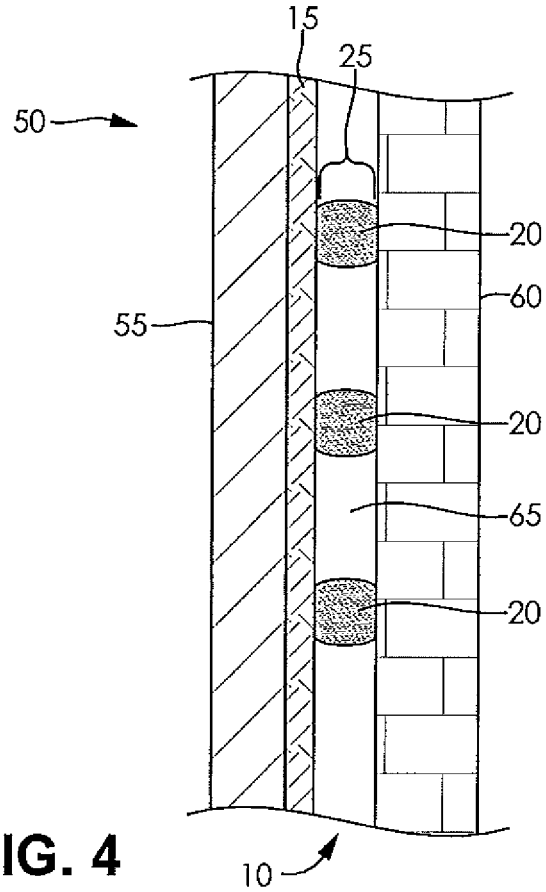
FIG. 4 shows a cross-sectional side view of the weather resistive barrier of FIG. 1 positioned between a sheathing material and an exterior building covering, where a space exists between the sheet and the exterior building covering formed by the protuberances, the space allowing air to circulate and/or water to drain.

With reference now to FIG. 4, the weather resistive barrier 10 is coupled to a structure 50 in order to protect the structure 50. As shown, the weather resistive barrier 10 is disposed between a sheathing material 55 and an exterior building covering 60. The flexible sheet 15 is adjacent the sheathing material 55 and the protuberances 20 abut the exterior building covering 60, where the height 25 of the protuberances projecting from the flexible sheet 15 provides a space 65 between the sheather material 55 and the exterior building covering 60. This space 65 allows water drainage and air movement to prevent damage to the structure 50.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms, and that neither should be construed to limit the scope of the disclosure. In some example embodiments, well-known processes, well-known device structures, and well-known technologies are not described in detail. Equivalent changes, modifications and variations of some embodiments, materials, compositions, and methods can be made within the scope of the present technology, with substantially similar results.

What is claimed is:

1. A method of making a weather resistive barrier comprising drop coating a material onto a flexible sheet by passing the material through a drop coating die to form a plurality of protuberances on at least one side, wherein the drop coating die comprises a cylinder having a plurality of perforations, a distance is maintained between the drop coating die and the flexible sheet, the material has one of a liquid, a semi-liquid, a gel, and a paste consistency, the flexible sheet having the plurality of protuberances formed thereon is configured as a house wrap, and the material is one of flexible and elastic.

2. The method of claim 1, wherein the plurality of perforations comprises one of a two-dimensional pattern on the cylinder and a two-dimensional repeating pattern.

3. The method of claim 1, further comprising rotating the cylinder while drop coating the material onto the flexible sheet.

4. The method of claim 2, further comprising moving one of the cylinder and the flexible sheet with respect to the other of the cylinder and the flexible sheet while drop coating the material onto the flexible sheet.

5. The method of claim 1, further comprising curing the material forming the plurality of protuberances.

6. A method of protecting a structure comprising:

making a weather resistive barrier by drop coating a material onto a flexible sheet by passing the material through a drop coating die to form a plurality of protuberances on at least one side, wherein the drop coating die comprises a cylinder having a plurality of perforations, a distance is maintained between the drop coating die and the flexible sheet, the material has one of a liquid, a semi-liquid, a gel, and a paste consistency, the flexible sheet having the plurality of protuberances formed thereon is configured as a house wrap, and the material is one of flexible and elastic; and coupling the weather resistive barrier to a structure.

7. The method of claim 6, wherein the weather resistive barrier is coupled to a sheathing material and further comprising covering the weather resistive barrier with an exterior building covering, thereby providing space between the sheathing material and the exterior building covering.

8. The method of claim 1, wherein the plurality of protuberances has a height of about 1 mm to about 10 mm.

9. The method of claim 1, wherein the plurality of protuberances is formed on each side of the flexible sheet.

10. The method of claim 1, wherein the plurality of protuberances comprises a polymeric material.

11. The method of claim 10, wherein the polymeric material comprises a thermoplastic polyolefin.

12. The method of claim 1, wherein the flexible sheet comprises a material permeable to water vapor.

13. The method of claim 1, wherein the flexible sheet comprises a material impermeable to water vapor.

14. The method of claim 1, wherein the flexible sheet comprises a non-woven material.

15. The method of claim 1, wherein the flexible sheet comprises a woven material.

16. The method of claim 1, further comprising continuously moving the material into the drop coating die to prevent the cylinder from running empty.

17. The method of claim 1, wherein the distance is substantially the same as a height of the protuberances.

18. The method of claim 1, wherein the material is heated prior to passing the material through the drop coating die.

* * * * *